US007913775B2

(12) United States Patent
Jeffryes et al.

(10) Patent No.: US 7,913,775 B2
(45) Date of Patent: Mar. 29, 2011

(54) SUBSURFACE FORMATION CORE ACQUISITION SYSTEM USING HIGH SPEED DATA AND CONTROL TELEMETRY

(75) Inventors: Benjamin P. Jeffryes, Cambridge (GB); Lee Dolman, ile de Re (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 335 days.

(21) Appl. No.: 11/965,537

(22) Filed: Dec. 27, 2007

(65) Prior Publication Data

US 2009/0166088 A1 Jul. 2, 2009

(51) Int. Cl.
*E21B 49/02* (2006.01)

(52) U.S. Cl. ..... 175/58; 175/249; 175/403

(58) Field of Classification Search ..... 175/50, 175/58, 239, 240, 244, 249, 250, 255, 332, 175/403

See application file for complete search history.

(56) References Cited

U.S. PATENT DOCUMENTS

| | | | | | |
|---|---|---|---|---|---|
| 1,994,847 | A | * | 3/1935 | Baker | 175/235 |
| 2,206,222 | A | * | 7/1940 | Creighton et al. | 175/270 |
| 2,256,092 | A | * | 9/1941 | Metz et al. | 175/405.1 |
| 2,634,106 | A | * | 4/1953 | Foster | 175/255 |
| 3,986,555 | A | * | 10/1976 | Robertson | 175/246 |
| 4,230,192 | A | * | 10/1980 | Pfannkuche | 175/59 |
| 4,356,872 | A | * | 11/1982 | Hyland | 175/58 |
| 4,492,275 | A | * | 1/1985 | Campbell et al. | 174/46 |
| 4,512,419 | A | * | 4/1985 | Rowley et al. | 175/58 |
| 5,460,230 | A | | 10/1995 | Dekoster | |
| 5,568,838 | A | * | 10/1996 | Struthers et al. | 175/246 |
| 5,984,023 | A | | 11/1999 | Sharma et al. | |
| 6,116,358 | A | * | 9/2000 | Fanuel | 175/250 |
| 6,158,534 | A | * | 12/2000 | Fanuel | 175/403 |
| 6,164,389 | A | * | 12/2000 | Fanuel et al. | 175/20 |
| 6,216,804 | B1 | * | 4/2001 | Aumann et al. | 175/236 |
| 6,412,575 | B1 | | 7/2002 | Harrigan et al. | |
| 7,124,841 | B2 | | 10/2006 | Wada et al. | |
| 7,168,506 | B2 | | 1/2007 | Boucher et al. | |
| 7,168,508 | B2 | | 1/2007 | Goldberg et al. | |
| 2006/0225926 | A1 | * | 10/2006 | Madhavan et al. | 175/320 |
| 2008/0156537 | A1 | * | 7/2008 | Stockton | 175/58 |
| 2009/0107724 | A1 | * | 4/2009 | Utter et al. | 175/50 |

FOREIGN PATENT DOCUMENTS

WO WO 2006058377 A1 * 6/2006

* cited by examiner

*Primary Examiner* — Daniel P Stephenson
*Assistant Examiner* — Blake Michener
(74) *Attorney, Agent, or Firm* — David J. Smith; Dave R. Hofman

(57) ABSTRACT

A core sample acquisition device includes a core receiving barrel configured to couple to a drill string proximate a core drilling bit. The device includes a sensor for determining a property of a core sample urged into the receiving barrel by drilling the core sample. The sample acquisition device includes a communication device for transmitting signals from the sensor over at least one of an electrical and an optical communication channel associated with the drill string.

20 Claims, 3 Drawing Sheets

SUBSURFACE FORMATION CORE ACQUISITION SYSTEM USING HIGH SPEED DATA AND CONTROL TELEMETRY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of devices and methods for obtaining samples (cores) of subsurface Earth formations during the drilling of wellbores. More specifically, the invention relates to coring devices and methods that use high speed data and control signal telemetry to improve the efficiency of core recovery.

2. Background Art

During drilling of wellbores through subsurface Earth formations, it is known in the alt to drill samples of such formations for recovery from the wellbore and subsequent analysis at the surface. Such sample taking is referred to as "coring." Coring typically includes drilling the wellbore using an annular drill bit, such that a substantially cylindrical sample of the formation is moved into a recovery chamber or "barrel" during the coring operation. It is desirable to maintain environmental conditions in the sample as close as is practicable to those existing in the subsurface at the depth of the core sample so that an accurate analysis of the fluid content, mineral composition and fluid transport properties of the sample may be made. Various devices are known in the art for maintaining such conditions and for making measurements of various physical parameters on the sample during its acquisition. One such device is disclosed in U.S. Pat. No. 5,984,023 issued to Sharma et al.

A limitation common to all coring techniques and devices known in the art is that they rely in indirect indicators to inform the wellbore operator as to the status of the core sampling operation. For example, it is necessary to infer that the entire core sample chamber ("core barrel") has been filled with a core sample by having drilled a length of the wellbore that is substantially equal to the axial length of the core barrel. It is not possible, using techniques known in the art, to determine whether the core barrel is in fact full of core sample without retrieval of the core drilling tool assembly from the wellbore. Further, it is not possible to be assured of the quality of a particular core sample, or that the core sample has even been retained in the core barrel, during retrieval of the core drilling tool assembly from the wellbore. All of the foregoing limitations can result in costly, inefficient coring operations.

Recently, a type of drill pipe ("wired drill pipe") that enables transmission of electrical power and/or electrical signals along a drilling tool assembly has been developed. One example of such wired drill pipe is disclosed in U.S. Patent Application Publication No. 2006/0225926 filed by Madhavan et al. and assigned to the assignee of the present invention. Such wired drill pipe has been adapted to transmit, substantially in real time to the surface measurements made of various properties of the subsurface formations. While such measurements are quite useful, they cannot entirely replace analysis of actual samples of the subsurface formations in order to accurately evaluate properties of subsurface oil, gas and/or water reservoirs.

There continues to be a need for improved coring devices and methods that better assure core recovery and core condition.

SUMMARY OF THE INVENTION

A core sample acquisition device according to one aspect of the invention includes a core receiving barrel configured to couple to a drill string proximate a core drilling bit. The device includes a sensor for measuring a property of a core sample urged into the receiving barrel by drilling the core sample. The sample acquisition device includes a communication device for transmitting signals from the sensor over at least one of an electrical and an optical communication channel associated with the drill string.

A method for acquiring a core sample according to another aspect of the invention includes drilling a core sample. The core sample is urged into a receiving barrel during the drilling of the core sample. A parameter related to a property of the core sample disposed in the receiving barrel is measured during the drilling of the core sample. The measured parameter is communicated to the Earth's surface using at least one of an electrical and optical communication channel in a drill string.

Other aspects and advantages of the invention will be apparent from the following description and the appended claims.

DETAILED DESCRIPTION

Figure 1:
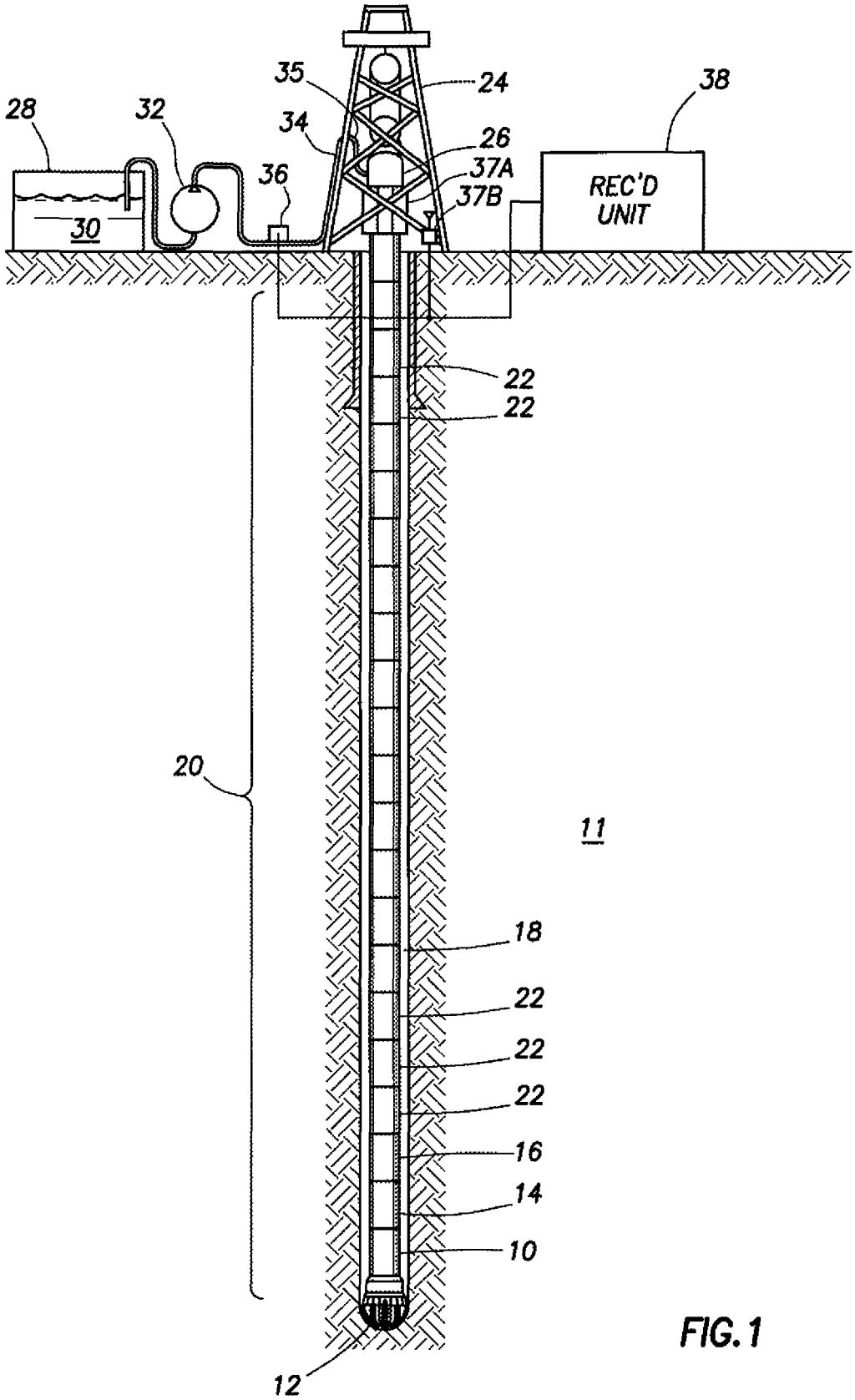
FIG. 1 shows an example drilling system including an example of a core recovery device according to the invention.

An example wellbore drilling system is shown in FIG. 1 and includes an example of a formation sample ("core") acquisition and storage device according to the invention. A drilling rig 24 or similar lifting device suspends a conduit called a "drill string 20" within a wellbore 18 being drilled through subsurface Earth formations 11. The drill string 20 may be assembled by threadedly coupling together end to end a number of segments ("joints") 22 of drill pipe. The drill string 20 may include a formation sample-taking drill bit 12 ("coring bit") at its lower end. A coring bit typically includes cutting elements that drill an annular hole through the subsurface formations, leaving an uncut, centrally disposed cylinder of formation as a result of drilling. One example of a coring bit is described in U.S. Pat. No. 6,412,575 issued to Harrigan et al. and assigned to the assignee of the present invention. See also U.S. Pat. No. 5,460,230 issued to Dekoster. Particular features of the drill bit 12 will be further explained with reference to FIG. 2, however, the configuration of the drill bit 12 other than its capability to drill a core sample is not a limit on the scope of this invention.

When the (frill bit 12 is axially urged into the formations 11 at the bottom of the wellbore 18 by the applying some of the weight of the drill string 20, and when it is rotated by equipment (e.g., top drive 26) on the drilling rig 24, such urging and rotation causes the bit 12 to axially extend ("deepen") the wellbore 18 by drilling the formations 11. As explained above and as will be further explained with reference to FIG. 2, such drilling may enable acquiring a sample of the formations 11 as a result of such drilling. The lower end of the drill string 20 may include, at a selected position above and typically proximate to the drill bit 12, a core sample acquisition and storage unit 10. The core sample acquisition and storage unit 10 may include one or more sensors (FIG. 2) for measuring selected properties of a formation core sample (FIG. 2) passed therethrough by the action of the dill bit 12. The one or more sensors (FIG. 2) in the sample storage unit 10 may be coupled to a telemetry transmitter or transceiver (FIG. 2) to communicate the measurements made thereby to the Earth's surface along an electrical and/or optical conductor (not shown separately) in the drill string 20. Proximate its lower end of the drill string 20 may also include an MWD instrument 14 and an LWD instrument 16 of types well known in the art.

During drilling of the wellbore 18, a pump 32 lifts drilling fluid ("mud") 30 from a tank 28 or pit and discharges the mud 30 under pressure through a standpipe 34 and flexible conduit 35 or hose, through the top drive 26 and into an interior passage (not shown separately in FIG. 1) inside the drill string 20. The mud 30 exits the drill string 20 through courses or nozzles (FIG. 2) in the drill bit 12, where it then cools and lubricates the drill bit 12 and lifts drill cuttings generated by the drill bit 12 to the Earth's surface. Some examples of MWD instrument 14 or LWD instrument 16 may include a telemetry transmitter (not shown separately) that modulates the flow of the mud 30 through the drill string 20. Such modulation may cause pressure variations in the mud 30 that may be detected at the Earth's surface by a pressure transducer 36 coupled at a selected position between the outlet of the pump 32 and the top drive 26. Signals from the transducer 36, which may be electrical and/or optical signals, for example, may be conducted to a recording unit 38 for decoding and interpretation using techniques well known in the art. The decoded signals typically correspond to measurements made by one or more of the sensors (not shown) in the MWD instrument 14 and/or the LWD 16 instrument, and may, in some examples, include measurements made by the storage unit 10. In the present example, such mud pressure modulation telemetry may be used in conjunction with, or as backup for an electromagnetic telemetry system included in "wired" drill pipe.

An electromagnetic transmitter (not shown separately) may be included in the either or both the sample storage unit 10 and LWD instrument 16, and may generate signals that are communicated along electrical conductors in the wired drill pipe. One type of "wired" drill pipe, as mentioned above in the Background section herein, is described in U.S. Patent Application Publication No. 2006/0225926 filed by Madhavan et al. and assigned to the assignee of the present invention. A wireless transceiver sub 37A may be disposed in the uppermost part of the drill string 20, typically directly coupled to the top drive 26. The wireless transceiver 37A may include communication devices to wirelessly transmit data between the drill string 20 and the recording unit 38, using a second wireless transceiver 37B associated with the recording unit.

It will be appreciated by those skilled in the art that the top drive 26 may be substituted in other examples by a swivel, kelly, kelly bushing and rotary table (none shown in FIG. 1) for rotating the drill string 20 while providing a pressure sealed passage through the drill string 20 for the mud 30. Accordingly, the invention is not limited in scope to use with top drive drilling systems, but may be used with any type of rotary drilling system.

In the example shown in FIG. 1, equipment (not shown separately) in the recording unit 38 may transmit command or control signals to the storage unit 10 using) the one or more electrical conductors (not shown separately) in the drill string 20. Operation of the core acquisition and storage unit 10 in response to such command or control signals will be further explained below.

Figure 2:
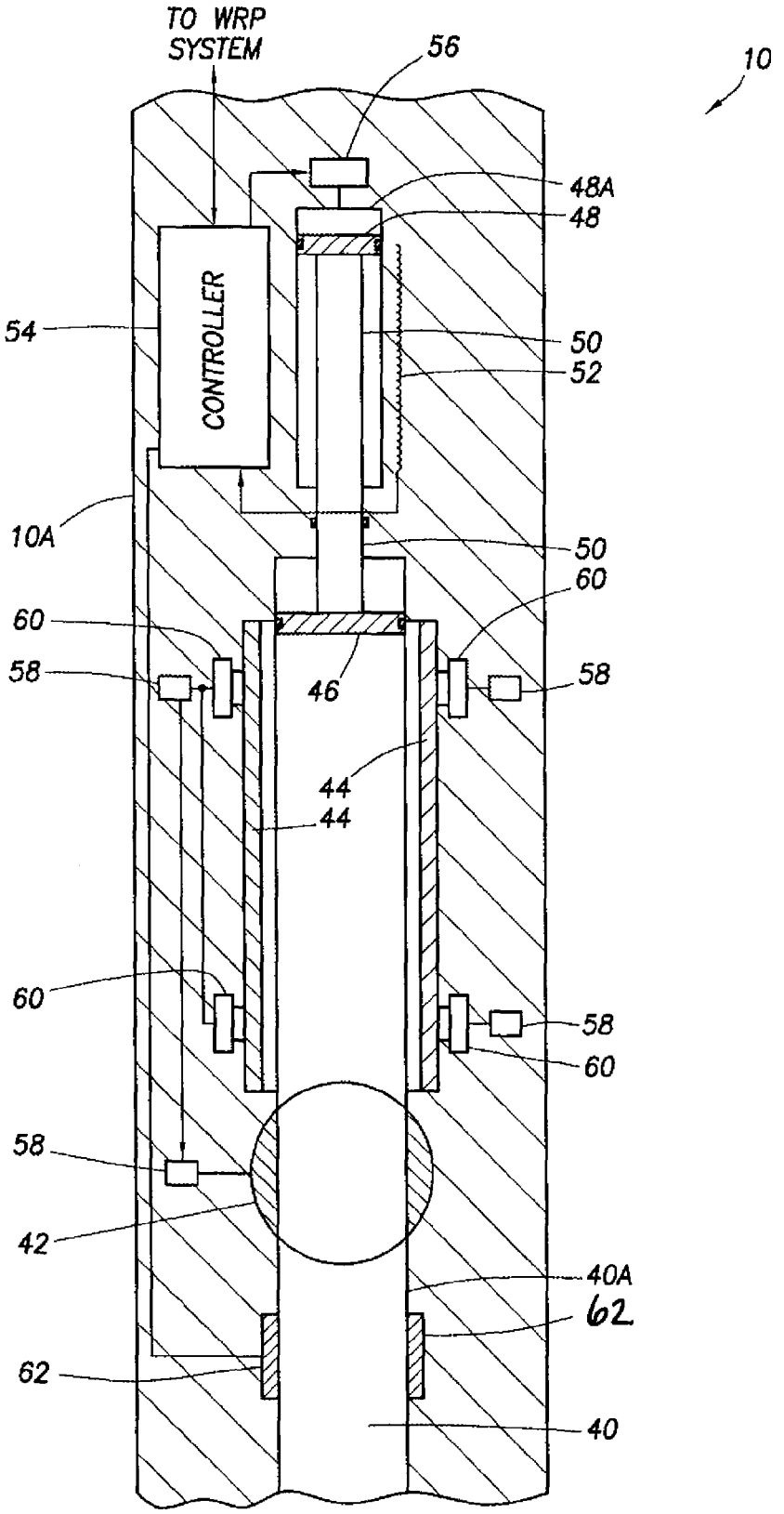
FIG. 2 shows an example core acquisition and storage device in more detail.

One example of a core acquisition and storage unit is shown in more detail in FIG. 2. The core acquisition and storage unit 10 may be disposed in a generally cylindrical housing 10A configured to be coupled within the drill string (20 in FIG. 1), typically directly adjacent to the drill bit (12 in FIG. 1). A core sample of the formation formed by the drill bit (12 in FIG. 1) as the wellbore is drilled is urged longitudinally into a core barrel 40, which may be rotatably mounted inside the housing 10A. The core barrel 40 may be in the form of a sleeve 40A that is rotatably and sealingly mounted inside the housing 10A to enable acquiring and retaining core samples while rotary drilling processes. One non-limiting example of a core drilling bit and a core barrel that may be used in various implementations is described in U.S. Pat. No. 7,124,841 issued to Wada et al. and incorporated herein by reference. It should be clearly understood that the foregoing example is only one possible implementation of a core drilling bit and a core receiving barrel, and therefore such example is not a limit on the scope of the present invention. Another example configuration of core barrel and core drilling bit is disclosed in U.S. Pat. No. 7,168,508 issued to Goldberg et al. A particularly useful feature of the device disclosed in the Goldberg et al. patent is that the core barrel is longitudinally disposed in approximately the same position along the drill string (20 in FIG. 1) as certain sensors in the LWD instrument (14 in FIG. 1). Such feature can enable more precise determination of where a core sample is desired to be obtained.

Initially, before any core sample is urged into the core barrel 40, a core receiving and ejecting piston 46 disposed in and cooperatively arranged with the core barrel 40 may be disposed toward the lower end of the core barrel 40. Such extension may be performed, for example, by a combination of ejector piston 48 disposed in an ejector cylinder 48A longitudinally above the core barrel 40. The ejector piston 48 may be coupled to the receiving and ejector piston 46 by a rod or link 50 coupled between the two pistons 46, 48. A solenoid operated hydraulic valve 56 may admit hydraulic fluid such as oil under pressure into the ejector cylinder 48A to urge the ejector piston 48 downwardly. Such motion is communicated to the receiving and ejecting piston 46 by the link 50. Corresponding downward motion of the receiving and ejecting piston 46 ejects the core sample through the central opening in the drill bit (12 in FIG. 1) when so desired by the system operator. Conversely, as a core sample is urged longitudinally into the core barrel 40 during drilling, such core sample urges the receiving and ejecting piston 46 to move upwardly and consequently to move the ejector piston 48 into its cylinder 48A. The solenoid valve 56 may be configured to enable, during such core sample acquisition, release of hydraulic fluid from the cylinder 48A through a selected orifice (not shown) so as to cause the receiving and ejecting piston 46 to maintain a selected axial pressure on the top of the core sample (not shown). Such pressure may provide that the longitudinal position of the receiving and ejecting piston 46 is substantially related to the amount of core sample filling the core barrel 40. As will be explained below, such positional relationship may be used in some examples to provide a signal indicative of when a core sample fully fills the core barrel 40. In such circumstances, the system operator may elect to retrieve the core acquisition unit 10 from the wellbore, or may elect to eject the core sample from the core barrel 40. In other examples, the core barrel 40 may be retrievable without removing the drill string (20 in FIG. 1) from the wellbore, and the system operator may retrieve the core sample by retrieval of the core sample-filled core barrel 40.

The ejector piston 48 may be made from, include or have associated therewith a magnetic material or a magnetically permeable material, so that its longitudinal position along the cylinder 48A may be determined using a pickup coil 52 or similar device to locate the longitudinal position of the ejector piston 48, and thus determine the longitudinal position of the receiving and ejecting piston 46. The pickup coil 52 may be arranged, for example, in the form of a linear variable differential transformer (LVDT). An LVDT generates a signal, when excited by alternating current, that is related to the longitudinal position of a magnetically permeable material with respect to the LVDT coil. Other devices for determining longitudinal position of the ejector piston 48 will occur to those of ordinary skill in the art. It should also be clearly understood that a longitudinal position determining sensor may also be or may alternatively be associated with or functionally coupled to the receiving and ejecting piston 46.

As is known in the art, some core samples are susceptible to falling out of the core barrel during or after acquisition. In the present example, to address such problem, a core sample may be held in place inside the core barrel 40 by suitably shaped retaining clamps or shoes 44 that are urged laterally inwardly to compress the core sample. Actuation of the shoes 44 may be performed by hydraulic cylinders 60. The hydraulic cylinders 60 may be actuated by solenoid valves 58. The solenoid valves 58 may be coupled to a source of hydraulic oil under pressure (not shown) just as the hydraulic valve 56 used to operate the ejector piston 48.

The core barrel 40 in some examples may include features (not shown separately) to enable retrieval of the core barrel 40 from inside the drill string (20 in FIG. 1) using a cable such as wireline of slickline, or coiled tubing or similar conveyance. After a core barrel having a core sample therein is retrieved, the same or a different core barrel may be reinserted into the drill string (20 in FIG. 1) and placed within it intended position the housing 10A. After replacement of the core barrel as described above, the process of drilling, evaluating and/or retrieving a core sample may be repeated if desired by the system operator.

A full diameter ball valve 42 or similar device may be included in some examples in order to selectively close and seal the bottom end of the core barrel 40, to retain the core and to maintain fluid pressure therein at essentially the fluid pressure existing in the wellbore at the place from which the core sample was taken. Closing such ball valve 42 can seal the core barrel 40 to prevent loss of fluid pressure. The ball valve may be actuated by a solenoid valve 58.

Operation of the foregoing solenoid valves 56, 58 may be performed by a controller 54, which may be any suitable microprocessor based controller. The controller 54 may include or may be associated with telemetry circuits (not shown separately) for transferring command signals and data over the wired drill pipe conductor(s) (in the drill string 20 in FIG. 1). Thus, all of the functions explained above with reference to measuring the position of a core sample within the core barrel 40, with ejecting the core sample from the core barrel 40, clamping the core sample in place in the core barrel 40, and ejecting the core sample from the core barrel 40 may be performed by the operator at the surface by sending suitable commands over the wired drill pipe (pipe string 20 in FIG. 1) to the controller 54, which may operate the appropriate hydraulic valves 56, 58.

Deciding whether to retain or eject a particular core sample may be facilitated by including one or more sensors 62 proximate an entry end of the core barrel 40. The sensors 62 may be any type known in the art, including, by way of example and without limitation, electrical resistivity, acoustic velocity, density, neutron slowing down length (porosity) and/or capture cross-section; natural gamma radiation and/or neutron activated gamma radiation. The measurements made by the various sensors 62 may be communicated to the surface using the conductor(s) in the wired drill pipe (drill string 20 in FIG. 1). The system operator may have opportunity to evaluate the measurements communicated from the sensors 62, and decide on the basis of such measurements whether the particular core sample should be retained or should be ejected. In the latter case, as explained above, the hydraulic valve 56 may be operated to move the ejector piston 48 downwardly to eject the core sample. The ejected core sample may be ground up by action of the drill bit (12 in FIG. 1) thereon. Core acquisition may resume at a place of the system operator's choosing. If the system operator elects to retain the particular core sample, suitable commands may be communicated along the conductor(s) in the wired drill pipe so that either or both the ball valve 42 is closed and the shoes 44 are moved inwardly.

Figure 3:
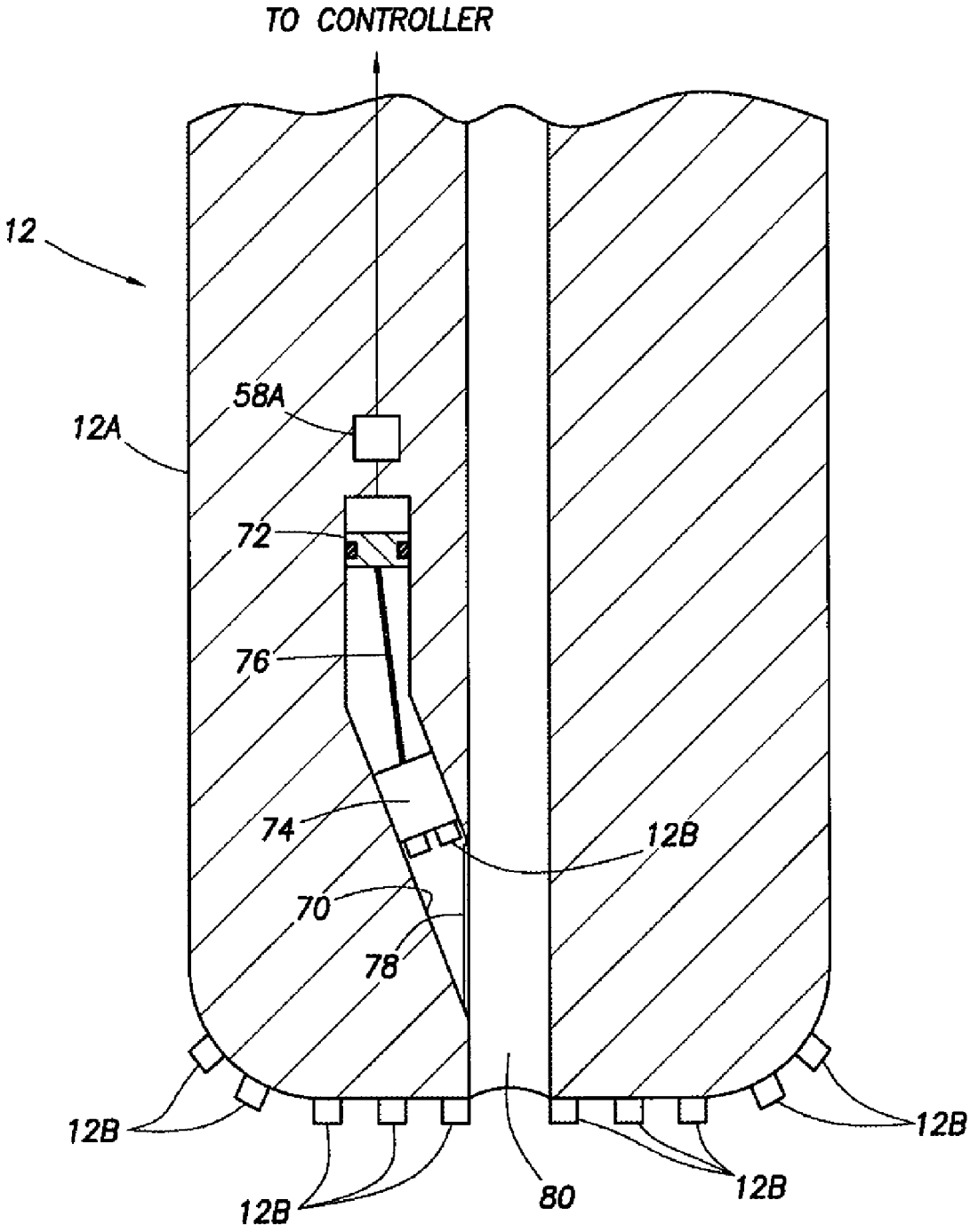
FIG. 3 shows an example of a core bit.

An example core bit that may be controlled using wired drill pipe (e.g., drill string 20 in FIG. 1) is shown schematically in FIG. 3. The drill bit 12 in the present example may be selectively configured to drill ordinary well hole when cores are not desired, and selectively configured to drill core samples when so desired. Such core bit 12 may be advantageously used in conjunction with the core acquisition and storage device shown in FIG. 2. The bit 12 in this example may include a bit body 12A formed from steel, or from powdered metal carbide (e.g., tungsten carbide) in a binder alloy. Cutting elements 12B such as polycrystalline diamond compact (PDC) cutters may be affixed to the bit body 12A in selected positions such that rotation of the bit body 12A causes cutting of the formations in the wellbore. A central passageway 80 in the bit body is configured to receive core samples therein as the bit 12 drills the subsurface formations. The passageway may be generally axially aligned with the core barrel (40 in FIG. 2).

A closure plug 74 having one or more cutting elements 12B on it end face, may be disposed in a bypass passage 70 that connects to the central passage 80. The closure plug 74 may be coupled to an hydraulic ram 72 by a link 76. The ram 72 may be extended and retracted along the bypass passage by admitting or releasing hydraulic pressure, such as by a solenoid operated valve 58A. Such solenoid operated valve 58A may be in signal communication with the controller (54 in FIG. 2). A hinge mounted door 78 may close the bypass passage 70 when the closure plug 74 is retracted therein. When the hydraulic ram 72 is extended, the closure plug 74 may be moved into the central opening out to the lowermost surface of the bit body 12A. When the plug 74 is in such position, the bit 12 is configured as an ordinary drill bit that drills the entire cross sectional area of the face of the bit. When the plug is retracted (as shown in FIG. 3), the bit 12 acts in the manner of a core bit. Thus, when measurements made by the various sensors explained with reference to FIG. 1 and FIG. 2 suggest that it is desirable to acquire a core sample, the system operator may cause the surface equipment to transmit a command along the conductor in the drill string (20 in FIG. 1), which may be decoded by the controller (54 in FIG. 2) to cause the solenoid valve 58A to operate to retract the plug 74. When ordinary drilling is to resume, the above procedure may be reversed. Such configuration of a bit as shown in FIG. 3 may reduce the need to "trip" the drill string (20 in FIG. 1) to change bits from a core bit to a conventional full cross section bit. Such configuration may also eliminate the need to insert specialized tools into the interior of the drill string to effect closure of the drill bit. See, for example U.S. Pat. No. 6,269,891 issued to Runia as illustrative of bit closures known in the art prior to the present invention.

A core sample acquisition device according to the various aspects of the invention may increase the efficiency of coring operations by providing analysis of the suitability of the core sample during acquisition and the capability of ejecting the core sample and acquitting an additional sample in the event the acquired sample is unsuitable. A core sample acquisition device according to the invention may provide more positive indication of when a core sample is fully acquired, so that unnecessary "tripping" of drill string from the wellbore, where a core sample is incompletely acquired, is reduced.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A core sample acquisition device, comprising:

a core receiving barrel configured to couple to a drill string proximate a core drilling bit;

a sensor for measuring a selected property of a core sample urged into the receiving barrel by drilling thereof;

a communication device for transmitting signals from the sensor over at least one of an electrical and an optical communication channel associated with the drill string; and a closure element permitting the core drilling bit to drill across a full cross-sectional area of the core drilling bit after the core sample is positioned within the receiving barrel without having to remove the core from the drill string.

2. The device of claim 1 further comprising at least one sensor for measuring a longitudinal extent of a core sample entering the core receiving barrel.

3. The device of claim 2 wherein the sensor for determining longitudinal extent comprises a pick up coil associated with a magnetic material, the magnetic material associated with a piston in contact with a longitudinal end of the core sample.

4. The device of claim 1 wherein the at least one sensor for measuring the selected property is selected from the group consisting of electrical resistivity, acoustic velocity, density, neutron slowing down length, neutron capture cross-section; natural gamma radiation and neutron activated gamma radiation.

5. The device of claim 1 further comprising means for ejecting the core sample from the core barrel.

6. The device of claim 4 wherein the means for ejecting comprises a piston and hydraulic cylinder.

7. The device of claim 1 further comprising a valve configured to close the core receiving barrel and retain fluid pressure therein.

8. The device of claim 7 wherein the valve comprises a ball valve.

9. The device of claim 1 further comprising means for retaining a core sample in the receiving barrel.

10. The device of claim 9 wherein the means for retaining comprises at least one shoe selectively operable to laterally compress at least one of the core receiving barrel and a core sample therein.

11. The device of claim 1 wherein the closure element is configured to selectively close a core opening in a the core drilling bit at a lower end of the drill string, and means operable to move the closure element from an extended position in the bit to a retracted position enabling acquisition of a core through the bit, the means operable to move configured to be controlled by signals transmitted along the communication channel.

12. The core sample acquisition device of claim 1 wherein the closure element permits the core drilling bit to drill across a full cross-sectional area of the core drilling bit after the core sample is ejected from the receiving barrel.

13. The core sample acquisition device of claim 1 wherein the closure element permits the core drilling bit to drill across a full cross-sectional area of the core drilling bit while the core sample remains within the receiving barrel.

14. A method for acquiring a core sample, comprising:

drilling a core sample;

urging the core sample into a receiving barrel during the drilling thereof;

measuring a parameter related to a property of the core sample disposed in the receiving barrel during the drilling of the core sample;

communicating the measured parameter to the Earth's surface using at least one of an electrical and optical communication channel in a drill string; and communicating a command along the communication channel to cause emplacement of a closure element in a central passage in a drill bit, and initiating drilling a wellbore across a full cross sectional area of the drill bit, wherein the closure element extends from a secondary passage into the receiving barrel.

15. The method of claim 14 wherein the measured parameter is selected from the group consisting of electrical resistivity, acoustic velocity, density, neutron slowing down length, neutron capture cross-section; natural gamma radiation and neutron activated gamma radiation.

16. The method of claim 14 further comprising ejecting the core sample from the receiving barrel, and repeating the drilling a core sample, urging the core sample, measuring the parameter related to a property of the core sample and communicating the measured parameter.

17. The method of claim 14 further comprising actuating means for retaining a core sample in the receiving barrel.

18. The method of claim 17 wherein the means for retaining comprises a valve.

19. The method of claim 17 wherein the means for retaining comprises at least one shoe selectively operable to laterally compress at least one of the core receiving barrel and a core sample therein.

20. The method of claim 14 further comprising determining a depth at which a core sample is to be acquired, transmitting a signal along the communication channel operative to cause removal of the closure element and resuming drilling the wellbore so as to acquire the core sample.

* * * * *